US006345962B1

(12) United States Patent
Sutter

(10) Patent No.: US 6,345,962 B1
(45) Date of Patent: Feb. 12, 2002

(54) FLUID OPERATED PUMP

(76) Inventor: Douglas E. Sutter, 508 Eight Ave., Menlo Park, CA (US) 94025

( * ) Notice: Subject to any disclaimer, the term of this patent is extended or adjusted under 35 U.S.C. 154(b) by 0 days.

(21) Appl. No.: 09/575,768

(22) Filed: May 22, 2000

(51) Int. Cl.[7] ..... F04B 45/00; F04B 43/06; F04B 17/00; F04B 19/24

(52) U.S. Cl. ..... 417/394; 417/395; 417/367; 417/53

(58) Field of Search ..... 417/53, 394, 395, 417/567

(56) References Cited

U.S. PATENT DOCUMENTS

| | | | | | |
|---|---|---|---|---|---|
| 225,930 | A | * | 3/1880 | Hoster | 417/339 |
| 1,282,145 | A | | 10/1918 | Tobler | 417/339 |
| 1,940,516 | A | | 12/1933 | Tennant | 417/383 |
| 2,291,912 | A | | 8/1942 | Meyeres | 417/244 |
| 2,450,751 | A | | 10/1948 | Elwood | 417/264 |
| 2,735,642 | A | | 2/1956 | Norman | 251/5 |
| 2,786,419 | A | | 3/1957 | Lynn | 417/394 |
| 3,007,416 | A | | 11/1961 | Childs | 417/383 |
| 3,039,309 | A | | 6/1962 | Vesper et al. | 73/863.24 |
| 3,048,114 | A | | 8/1962 | Browne | 417/394 |
| 3,105,708 | A | | 10/1963 | Esty | 285/41 |
| 3,194,170 | A | | 7/1965 | Umbing | 417/394 |
| 3,304,881 | A | * | 2/1967 | Grise | 103/152 |
| 3,362,618 | A | * | 1/1968 | Fortinov | 230/52 |
| 3,406,633 | A | | 10/1968 | Schomburg | 417/394 |
| 3,427,987 | A | * | 2/1969 | Eull | 417/394 |
| 3,635,607 | A | * | 1/1972 | Grise | 417/394 |
| 3,639,084 | A | * | 2/1972 | Goldhaber | 417/394 |
| 3,762,838 | A | * | 10/1973 | Sate | 417/395 |
| 3,957,401 | A | * | 5/1976 | Sweeny et al. | 417/395 |
| 4,111,613 | A | * | 9/1978 | Sperry | 417/394 |
| 4,120,424 | A | * | 10/1978 | Zygiel | 222/133 |
| 4,250,872 | A | | 2/1981 | Tamari | 600/16 |
| 4,269,906 | A | * | 5/1981 | Schmechtig | 429/67 |
| 4,303,376 | A | | 12/1981 | Siekmann | 417/360 |
| 4,439,112 | A | * | 3/1984 | Kitsnik | 417/394 X |
| 4,469,544 | A | | 9/1984 | Goodman | 156/345 |
| 4,515,536 | A | | 5/1985 | van Os | 417/394 |
| 4,604,037 | A | * | 8/1986 | Hoya | 417/394 |
| 4,622,990 | A | * | 11/1986 | Norman | 417/567 X |
| 4,650,471 | A | | 3/1987 | Tamari | 604/153 |
| 4,701,107 | A | * | 10/1987 | Dickinson et al. | 417/86 |
| 4,854,836 | A | | 8/1989 | Borsanyi | 417/474 |
| 4,950,245 | A | | 8/1990 | Brown | 604/153 |
| 4,983,102 | A | * | 1/1991 | Swain | 417/394 |
| 5,125,801 | A | | 6/1992 | Nabity et al. | 417/44 |
| 5,273,406 | A | | 12/1993 | Feygin | 417/474 |
| 5,401,139 | A | | 3/1995 | Nabity et al. | 417/63 |
| 5,846,064 | A | | 12/1998 | Refson | 417/474 |
| 5,891,505 | A | * | 4/1999 | Schuman et al. | 426/665 |
| 6,065,944 | A | * | 5/2000 | Cobb | 417/394 |

* cited by examiner

*Primary Examiner*—Charles G. Freay
*Assistant Examiner*—Timothy P. Solak
(74) *Attorney, Agent, or Firm*—Goldstein Law Offices, P.C.

(57) ABSTRACT

A pump, for moving a pumped fluid using a pumping fluid, comprising an outer housing defining an interior volume. A compressible main tube, having an interior space, is located within the outer housing. Inlet and exit valves, both having internal check valves, are in communication with the interior space of the compressible main tube. The outer housing is selectively filled with pressurized pumping fluid through a drive intake to compress the main tube and force pumped fluid contained therein out through the exit valve. The pressurized pumping fluid is then released through a bleeder valve to relieve pressure upon the main tube, allowing it to expand, and causing it to draw pumped fluid into its interior space through the inlet valve. Reiteration of these steps is controlled by a solenoid valve which selectively allows or prevents flow of the pumping fluid through the drive intake into the internal volume of the outer housing.

11 Claims, 4 Drawing Sheets

FLUID OPERATED PUMP

BACKGROUND OF THE INVENTION

The invention relates to a fluid operated pump. More particularly, the invention relates to a pump which employs the pressure of one fluid to move another fluid in an efficient and inexpensive manner.

Moving fluid is an engineering problem which has been studied for thousands of years. During that time, countless "pumps" have been devised which seek to move fluid using a variety of different energy sources. From windmills to electrostatics, pumps have taken many forms.

The most basic pump employs mechanical energy to move a fluid. The mechanical energy is often supplied by an electric motor which turns a turbine. However, different pumping schemes have been developed to meet the specific goals required by more demanding applications. Such goals include isolation of hazardous and corrosive substances, maintaining sterility in biomedical applications, providing a continuous flow which is free from surges, etc.

One general class of pump which has been developed is the peristaltic pump. Peristaltic pumps move a fluid within a tube by actually squeezing the tube itself. The squeezing is performed sequentially or continuously along the tube to urge the fluid to move in the direction that the squeezing progresses. Generally the tube is squeezed by mechanical action, wherein rollers are employed to engage the tube. Such a pump requires a complex mechanism to operate, and therefore is expensive to manufacture. In addition, the repeated mechanical contact with the tube causes wear upon said tube and limits the effective life of the pump.

One non-mechanical variation on the peristaltic pump is disclosed in U.S. Pat. No. 4,515,536 to van Os. This device employs fluid pressure to compress a hose. The hose has a supply end and a discharge end. Fluid pressure is gradually applied upon the hose starting at the supply end to urge fluid within the hose toward the discharge end. However, the complexity and fluid dynamic precision required for operation make this device unreliable and impractical.

U.S. Pat. No. 3,039,309 to Vesper et al. discloses a pneumatically actuated pump and sampling system. Vesper discloses a flow-through pump of considerable complexity, requiring a tight fit between its elastic hose and housing, as well as a sequencing system to precisely supply pressure at several different points at different times during the pumping sequence.

U.S. Pat. No. 3,406,633 to Schomburg discloses a collapsible chamber pump which employs pressure from a cam operated piston to compress a chamber. The chamber allows flow through the chamber in one direction only using a single check valve. However, if the tube is not designed for controlled collapse, much of the energy exerted will be wasted on backpressure, and will likely cause unwanted backflow.

While these units may be suitable for the particular purpose employed, or for general use, they would not be as suitable for the purposes of the present invention as disclosed hereafter.

SUMMARY OF THE INVENTION

It is an object of the invention to produce a pump which can effectively move a pumped fluid using a pumping fluid with no contact between said fluids. Accordingly, the pumped fluid is completely isolated from the pumping fluid.

It is another object of the invention to provide a pump which is inexpensive to manufacture and operate, and is configured for durability and reliability. Accordingly, the pump employs minimal working parts, and thus is inexpensive to manufacture and reliable in use.

It is another object of the invention to provide a pump which is capable of harnessing energy from an air or liquid source. Accordingly, the pump configuration is directly adaptable for hydraulic and pneumatic pumping fluid operation.

It is yet another object of the invention to provide a pump which can create a significant vacuum at its pump inlet while pumping a gas or a liquid, without requiring a flooded inlet, and without cavitation.

The invention is a pump, for moving a pumped fluid using a pumping fluid, comprising an outer housing defining an interior volume. A compressible main tube, having an interior space, is located within the outer housing. Inlet and exit valves, both having internal check valves, are in communication with the interior space of the compressible main tube. The outer housing is selectively filled with pressurized pumping fluid through a drive intake to compress the main tube and force pumped fluid contained therein out through the exit valve. The pressurized pumping fluid is then released through a bleeder valve to relieve pressure upon the main tube, allowing it to expand, and causing it to draw pumped fluid into its interior space through the inlet valve. Reiteration of these steps is controlled by a solenoid valve which selectively allows or prevents flow of the pumping fluid through the drive intake into the internal volume of the outer housing.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DESCRIPTION OF THE DRAWINGS

In the drawings, like elements are depicted by like reference numerals. The drawings are briefly described as follows.

DETAILED DESCRIPTION OF THE PREFERRED EMBODIMENTS

For the purposes of the following discussion, "fluid" can refer to either a gas or liquid, since hydraulic as well as pneumatic drive sources may be used interchangeably with the present invention. In addition, pumped fluid refers to fluid which is moved by the pump, and pumping fluid refers to fluid used as a power source to move said pumped fluid.

Figure 1:
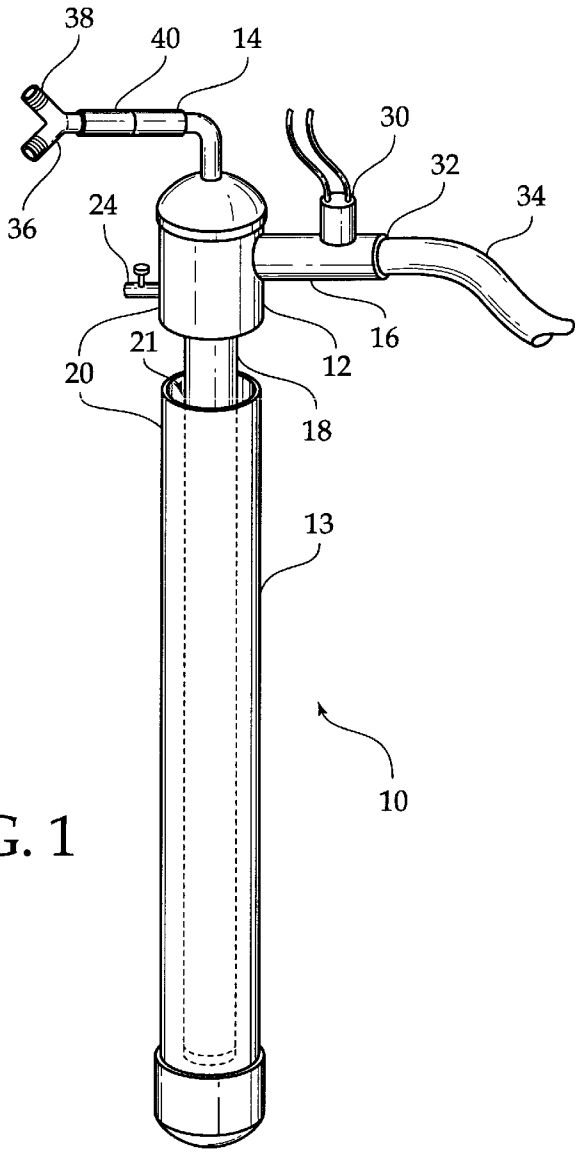
FIG. 1 is a diagrammatic perspective view of the invention, wherein the lower housing has been detached from the pump head and has been lowered slightly to reveal the main tube located therein.

FIG. 1 illustrates a pump 10, comprising an outer housing 20 which includes a pump head 12 and a lower housing 13. A valve junction 14, a drive intake 16, and a collapsible main tube 18 are all attached to the pump head 12. The lower housing 13 extends over the main tube 18 and seals to the pump head 12, creating an interior volume 21 within said outer housing 20 and surrounding said main tube 18. The pump head also has a bleeder valve 24 attached to said pump head 12.

The drive intake 16 includes a drive intake solenoid valve 30 and an drive intake opening 32, where a drive source 34 is connected. The drive intake solenoid valve 30 selectively allows flow from the intake opening 32 through the drive intake 16 to the pump head 12.

Figure 2:
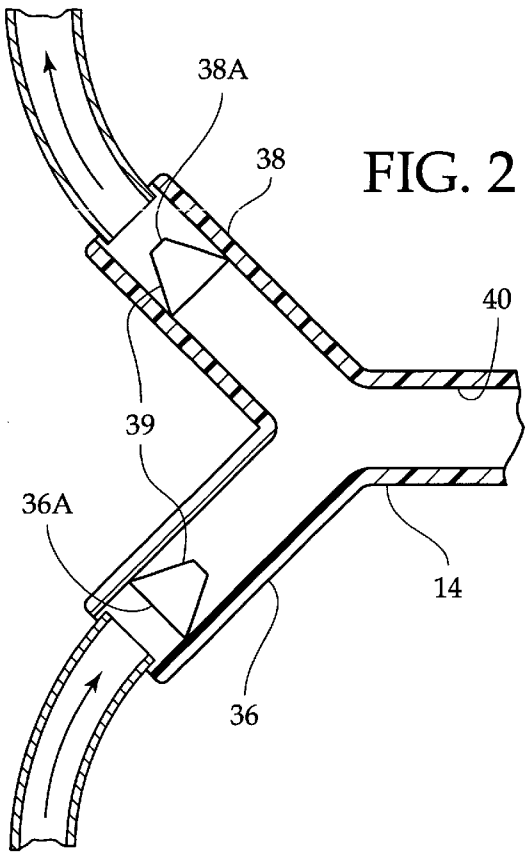
FIG. 2 is a cross sectional view of the valve junction, indicating the flow direction dictated by the check valves.

The valve junction 14 is Y-shaped, including an inlet valve 36 and an exit valve 38 which are both connected to the pump head 12 with a two-way conduit 40. FIG. 2 details the valve junction 14, wherein the inlet valve 36 has an inlet valve opening 36A, and the exit valve 38 has an exit valve opening 38A. Both the inlet valve 36 and exit valve 38 have internal check valves 39, such that the inlet valve 36 only allows flow from the inlet valve opening 36A to the two-way conduit 40, and the exit valve 38 only allows flow from the two-way conduit 40 to the exit opening 38A.

Figure 3:
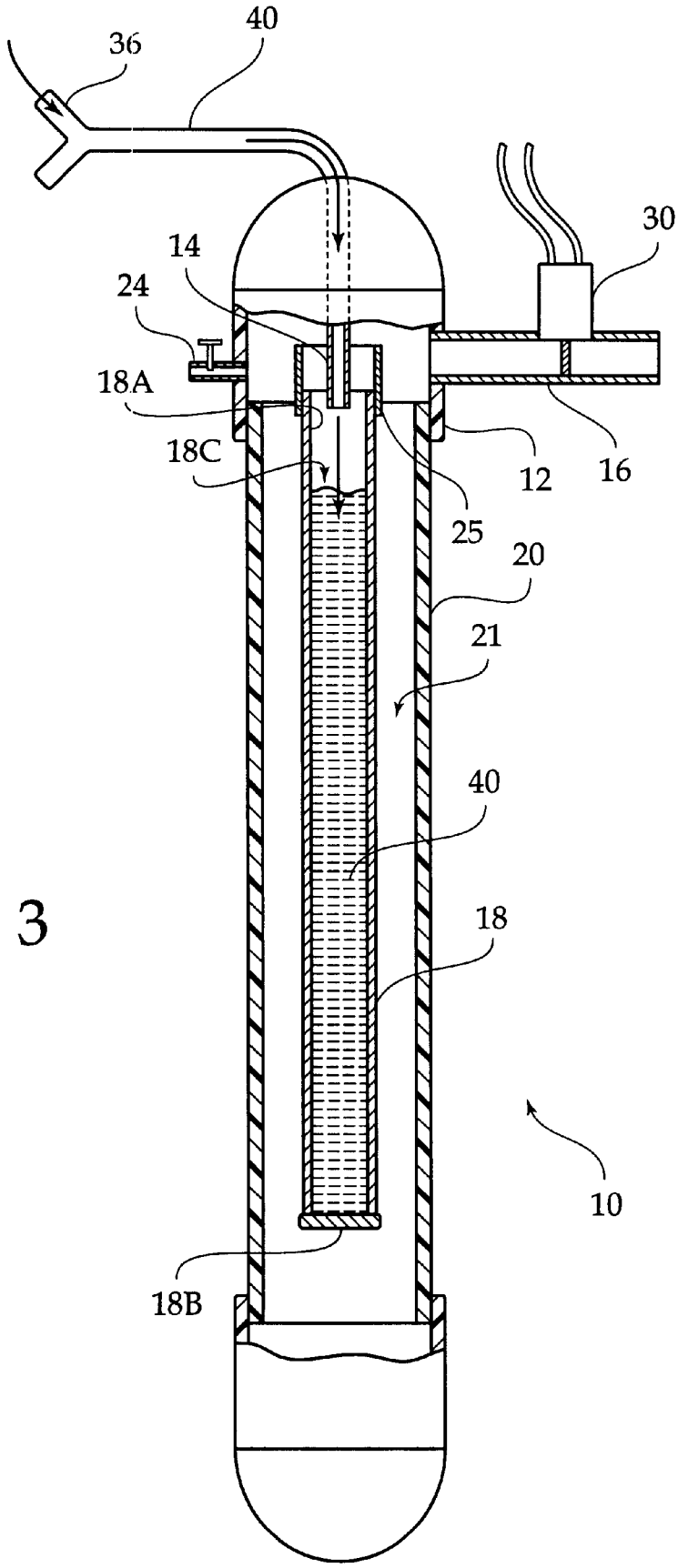
FIG. 3 is a cross sectional view, illustrating the main tube filling during the pumping cycle.

FIG. 3 is a cross sectional view, with parts broken away, illustrating the pump 10. As illustrated, the drive intake 16 is in fluid communication with the interior volume 21 created between the pump head 12 and outer housing 20. Also, the bleeder valve 24 is in fluid communication with said interior volume 21.

FIG. 3 also illustrates the main tube 18. The main tube 18 has an open end 18A and a sealed end 18B. Within the main tube 18, between the open end 18A and sealed end 18B, and interior space 18C is created. The valve junction 14 is in fluid communication with the main tube 18.

The main tube 18 is made of a flexible material such that it is compressible to expel the pumped fluid 40 from the interior space 18C thereof and expands to draw the pumped fluid 40 into the interior space 18C thereof. The main tube 18 must have sufficient strength and memory characteristics so that it has a natural tendency to restore to its cylindrical shape so as to draw the pumped fluid 40 into the interior space thereof 18C. The main tube's memory strength refers to the external force necessary to elastically deform the tube and cause it to compress, and the resulting outward force exerted by the main tube seeking to restore itself to its cylindrical form. The actual memory strength of the tube will determine the suction power of the pump. Additional design constraints for the main tube 18 will be described in further detail below.

In FIG. 3, pumped fluid 40 is shown flowing into the main tube 18 through the inlet valve 36 and then the two-way conduit 40 of said valve junction 14. The open end 18A is sealed to the valve junction 14 with a cap 25 so that the interior space 18C of the main tube 18 is isolated from the interior volume 21 within the outer housing 20 outside of said main tube 18. The drive intake solenoid valve 30 is closed, preventing flow into the interior volume 21.

Figure 4:
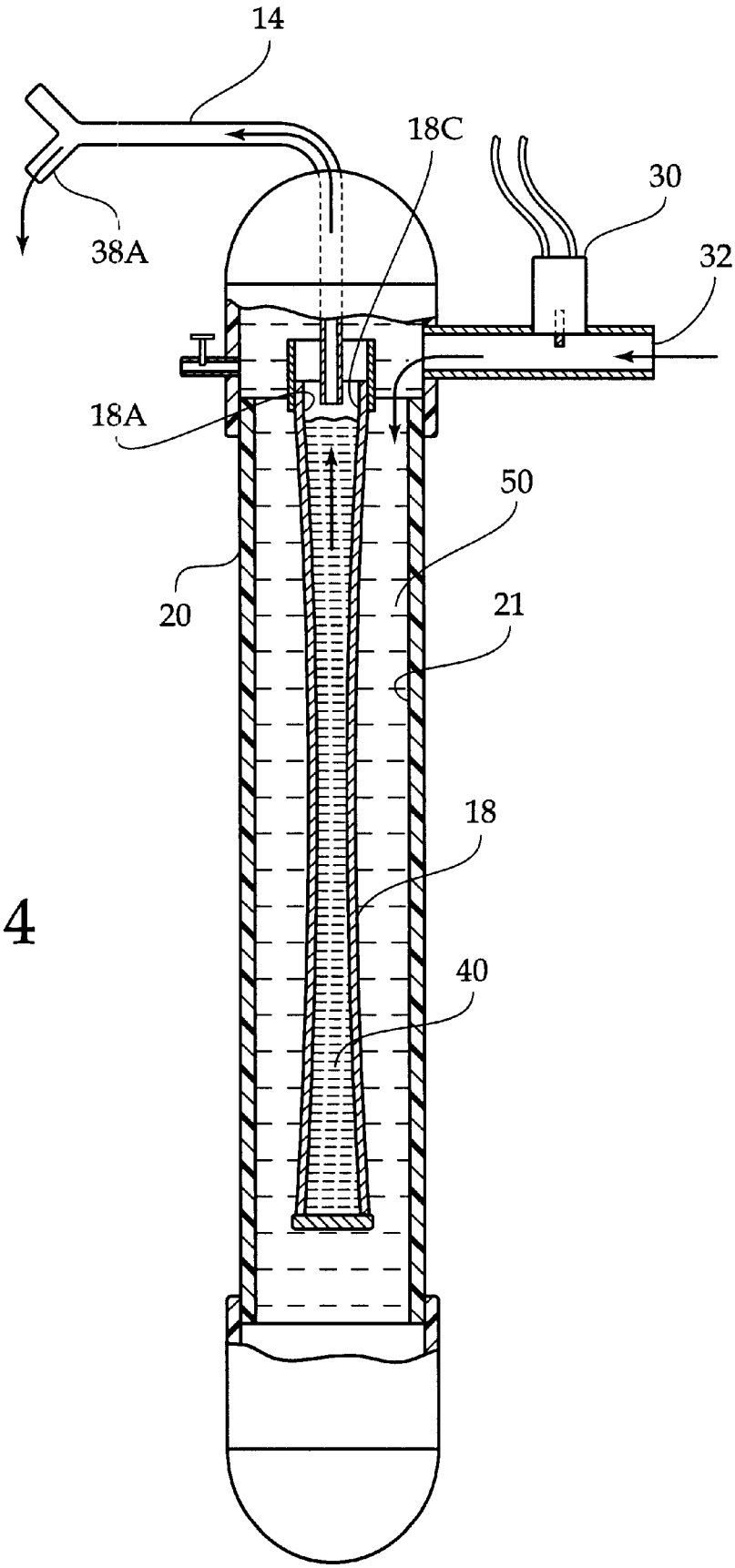
FIG. 4 is a cross sectional view, wherein the solenoid is open, causing the interior volume of the outer housing to pressurize, such that the main tube is squeezed by fluid pressure within the outer housing.

In FIG. 4, The drive intake solenoid valve 30 is opened, allowing flow of pumping fluid 50 from the drive source through the drive intake opening 32 into the interior volume 21 within the outer housing 20. As the interior volume 21 is pressurized by the pumping fluid 50, the memory strength of the main tube 18 is overcome, causing the main tube 18 to be compressed, and causing the pumped fluid 40 within the interior space 18C thereof to be expelled out of the open end 18A thereof, through the valve junction 14, and out the exit valve opening 38A.

Figure 5:
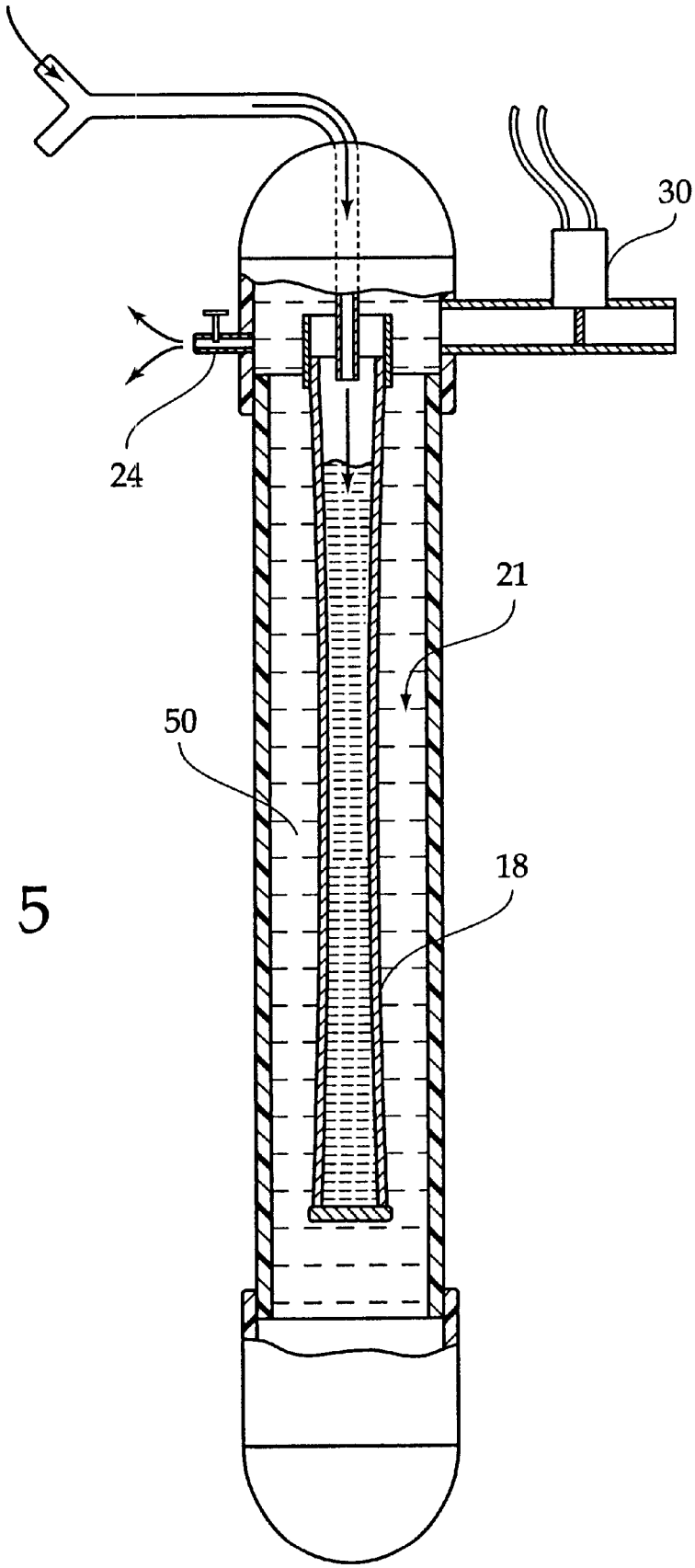
FIG. 5 is a cross sectional view, wherein the solenoid is closed, and pressure from the interior volume of the main housing slowly bleeds therefrom through the bleeder valve, such that the main tube is allowed to expand, drawing fluid into said main tube.

Now that fluid has been expelled, in order to complete a pumping cycle, the main tube 18 once again must be allowed to expand. In order for the main tube 18 to expand, pressure exterted thereupon by the pumping fluid 50 must be relieved, as shown in FIG. 5. Accordingly, the bleeder valve 24 slowly relieves pressure within the interior volume 21. The flow of the bleeder valve 24 must be carefully adjusted so as to not bleed off pressure within the interior volume 21 too quickly, but to also ensure that the main tube 18 is allowed to fully expand during the pumping cycle. In addition, the amount of pressure relief will dictate the amount of suction created by the expansion of the main tube 18.

The pumping cycle itself is clearly initiated by opening the drive intake solenoid valve 30. Commonly, said solenoid valve would be electrically operated, either at timed intervals, or in response to sensors which determine the appropriateness of initiating a pump cycle. If the solenoid valve 30 is operated at timed intervals, the intervals should be selected so as to both allow the interior volume to pressurize to compress the main tube, and allow the pressure to bleed so that the main tube expands, before the pumping cycle is repeated.

Now that the operation of the pump 10 is apparent, certain design constraints should be considered in selecting the main tube, and in calibrating the bleeder valve.

First, the main tube should be selected according to the drive source and the pressure of the pumping fluid supplied thereby. Accordingly, the pressure must be sufficient to overcome the memory strength of the main tube, so that once the outer housing is pressurized, the main tube will be fully compressed. Further, the pressure of the pumping fluid must exceed the memory strength (outward pressure) of the main tube by whatever outflow pressure is desired.

Second, the main tube should be selected according to the desired suction. The suction of the pump, and its tendency to draw fluids or create a vacuum is determined by the memory strength of the main tube. The tendency of the main tube to expand alone causes fluid to be drawn into the main tube.

Third, the bleeder valve should be calibrated according to the flow rate of the pumping fluid, and the desired pump cycle time. The suction power of the main tube as it expands is reduced by external pressure on the main tube from the pumping fluid. The external pressure on the main tube is diminished as pressure is relieved through the bleeder valve. Accordingly, the more quickly pressure escapes through the bleeder valve, the more quickly the main tube expands, creating suction. Conversely, the slower pressure escapes through the bleeder valve, the slower the pumped fluid will be drawn into the main tube.

It should be apparent that the pump will function equally well whether the pumping fluid is either a liquid or a gas. Compensation for the compressibility of gas can be easily made. In addition, the pump can be used wherein the pumped fluid is a liquid or gas. In other words, the pump can be quite effective at gas evacuation for creating a vacuum. The extent of the vacuum is limited only by the selection and strength of the main tube, housings, and valves.

What is claimed is:

1. A pump, for conveying a pumped fluid using a pumping fluid supplied by a drive source, comprising:

an outer housing defining an interior volume;

a drive intake having a drive intake opening that connects to the drive source for allowing the interior volume to pressurize with the pumping fluid, the drive intake having a drive intake valve interposed between the drive intake opening and the internal volume of the outer housing for selectively allowing and preventing flow of the pumping fluid into said internal volume;

a valve junction having an inlet valve and an exit valve which are both in communication with a two-way tube and which both have internal check valves;

a main tube having an interior space which is isolated from the internal volume of the outer housing, the main tube located within the interior volume of the outer housing, the inlet valve in communication with the main tube to allow the main tube to fill with pumped fluid, the exit valve in communication with the main tube to allow pumped fluid to be expelled from the main tube, the main tube compressible by the pumping fluid to expel the pumped fluid from the main tube out through the exit valve, the main tube also having a tendency to fully expand when pressure exerted thereupon by said pumping fluid is relieved; and a bleeder valve, in communication with the internal volume, for bleeding off pressurized pumping fluid from said internal volume to allow the main tube to expand and thereby draw pumped fluid into its internal space from the inlet valve and through the two-way tube.

2. The pump as recited in claim 1, wherein the intake valve has an intake valve opening, the exit valve has an exit valve opening, and wherein both of said valves have internal check valves such that the intake valve only allows flow from the intake valve opening to the main tube and the exit valve only allows flow from the main tube out of the exit valve.

3. The pump as recited in claim 2, wherein the drive intake valve is a solenoid valve which is operated at timed intervals which are selected so that when flow of the pumping fluid is allowed thereby the main tube is fully compressed, and that the bleeder valve can bleed the pressurized pumping fluid so that main tube can fully expand before the pumping fluid is once again allowed to flow into the internal volume from the drive intake.

4. A pump, for conveying a pumped fluid using a pumping fluid supplied by a drive source, comprising:

an outer housing defining an interior volume;

a drive intake having a drive intake opening that connects to the drive source for allowing the interior volume to pressurize with the pumping fluid;

a valve junction having an inlet valve and an exit valve which are both in communication with a two-way tube and which both have internal check valves, the inlet valve for allowing pumped fluid into the two-way tube;

a main tube having a closed end and an open end, the main tube having an interior space which is isolated from the internal volume of the outer housing, the main tube located within the interior volume of the outer housing, the two-way tube connected to the open end of the main tube to allow the main tube to fill with pumped fluid, the main tube compressible by the pumping fluid to expel the pumped fluid from the main tube out through the two-way tube and then through the exit valve, the main tube also having a tendency to fully expand when pressure exerted thereupon by said pumping fluid is relieved; and a bleeder valve, in communication with the internal volume, for bleeding off pressurized pumping fluid from said internal volume to allow the main tube to expand and thereby draw pumped fluid into its internal space from the inlet valve and through the two-way tube.

5. The pump as recited in claim 4, wherein the drive intake further comprises a drive intake valve interposed between the drive intake opening and the internal volume of the outer housing for selectively allowing and preventing flow of the pumping fluid into said internal volume.

6. The pump as recited in claim 5, wherein the intake valve has an intake valve opening, the exit valve has an exit valve opening, and wherein both of said valves have internal check valves such that the intake valve only allows flow from the intake valve opening to the two-way tube and the exit valve only allows flow from the two-way tube out of the exit valve.

7. The pump as recited in claim 6, wherein the drive intake valve is a solenoid valve which is operated at timed intervals which are selected so that when flow of the pumping fluid is allowed thereby the main tube is fully compressed, and that the bleeder valve can bleed the pressurized pumping fluid so that main tube can fully expand before the pumping fluid is once again allowed to flow into the internal volume from the drive intake.

8. A pumping method, for moving a pumped fluid with a pumping fluid, using a pump having an outer housing defining an internal volume, a drive means in communication with the internal volume of the outer housing, a compressible main tube located within the outer housing, the compressible tube having an interior space isolated from the internal volume, a valve junction having an inlet valve and an exit valve which are both in communication with the inner space via a two-way tube, comprising the steps of:

(a) compressing the main tube by pressurizing the internal volume of the outer housing with pumping fluid by periodically allowing the drive means to supply the pumping fluid to said internal volume of the outer housing;

(b) drawing pumped fluid into the interior space from the inlet valve by expanding the main tube by relieving pressure exerted by the pumping fluid on the main tube; and (c) expelling pumped fluid from the interior space through the exit valve by compressing the main tube by pressurizing the internal volume of the outer housing with pumping fluid (d) repeating steps (b) and (c).

9. The pumping method as recited in claim 8, wherein the pump further has a bleeder valve in communication with the internal volume, and wherein the step of relieving pressure exerted by the pump further comprises bleeding the pumping fluid from the internal volume by the bleeder valve.

10. The pumping method as recited in claim 9, wherein the pump has a drive intake in communication with the internal volume of the housing, wherein pumping fluid is supplied to the internal volume through the drive intake, wherein the drive intake has a drive intake valve for selectively allowing pumping fluid to flow into the internal volume, and wherein the step of expelling pumped fluid from the interior space of the main tube is initiated by allowing the flow of pumping fluid into the internal volume by actuating said valve.

11. The pumping method as recited in claim 10, wherein the step of drawing pumped fluid into the interior space of the main tube through the inlet valve further comprises preventing flow through the exit valve, and wherein the step of expelling pumped fluid from the main tube through the exit valve further comprises preventing flow through the inlet valve.

* * * * *